US005269476A

United States Patent [19]

Roessler

[11] Patent Number: 5,269,476

[45] Date of Patent: Dec. 14, 1993

[54] COMMINUTING APPARATUS

[76] Inventor: Kurt Roessler, Blankenburger Strasse 21 a, 4550 Bramsche, Fed. Rep. of Germany

[21] Appl. No.: 761,130

[22] Filed: Sep. 17, 1991

[30] Foreign Application Priority Data

Sep. 19, 1990 [EP] European Pat. Off. ..... 90118017.4

[51] Int. Cl.[5] ..... B02C 7/04

[52] U.S. Cl. ..... 241/260; 241/46.06

[58] Field of Search ..... 241/46.06, 46.08, 86, 241/162, 169.1, 242, 245, 257, 258, 260, 260.1

[56] References Cited

U.S. PATENT DOCUMENTS

| | | | |
|---|---|---|---|
| 1,762,592 | 6/1930 | Schwartz | 241/162 X |
| 4,562,972 | 1/1986 | Hagiwara et al. | 241/162 X |
| 5,016,825 | 5/1991 | Carpenter | 241/46.06 |

*Primary Examiner*—Douglas D. Watts

*Attorney, Agent, or Firm*—Jordan and Hamburg

[57] ABSTRACT

An apparatus for comminuting commercial and industrial waste, particularly for comminuting paper, wood, plastics, etc., with a material loading chamber, as well as a material outlet region with a receiving container having an outlet opening for the material to be comminuted and with a comminuting mechanism, which is disposed in the receiving container and comprises a comminuting tool that can be caused to rotate by means of a drive motor. In order to create, particularly with a reduced construction and design effort, a comminuting apparatus, with which material can be comminuted effectively to a predetermined extent, the comminuting mechanism comprises at least two, essentially coaxially disposed comminuting tools one of which can be caused to rotate by means of the drive motor, the other of which, on the other hand, is disposed to be stationary or to rotate at a low rotational speed. Moreover, one of the comminuting tools has classification form recesses which are open towards the other comminuting tool. The other comminuting tool has at least two pocket recesses which can be connected with the classification form recesses, one pocket recess being assigned to the material loading chamber and the other pocket recess being assigned to the material outlet region.

15 Claims, 3 Drawing Sheets

COMMINUTING APPARATUS

The invention is directed to an apparatus for comminuting commercial and industrial waste, particularly for comminuting paper, wood, plastics, etc.

BACKGROUND OF THE INVENTION

Comminuting apparatuses of the above-described type are known in very different designs. If commercial or industrial waste, such as wood, is to be comminuted to a particular extent with such apparatuses, the consecutive disposal of several comminuting steps or comminuting steps or mechanisms, for example, is known. Moreover, for impeller breakers for example, it is known to combine a comminuting mechanism with a screening device in order to obtain comminuted material of the desired size or consistency. Such conventional comminuting apparatuses have the common disadvantage that, between the comminuting steps or between the comminuting mechanism and the classification apparatus, the comminuted material must pass through paths or overcome distances, which usually is to be brought about by gravitational or centrifugal forces. Particularly with lightweight, moist or greasy comminuted material, this is usually very difficult to carry out and only with the danger of blocking the apparatus and the like. Moreover, with multi-step comminuting apparatuses, the exact coordination of the individual comminuting steps creates problems. Because of the irregular comminution in a comminuting step, this usually leads to a larger dimensioning of the subsequent step. The design and construction costs associated therewith are appreciable, with the result that the production costs are considerable and that such apparatuses therefore are expensive.

SUMMARY OF THE INVENTION

It is an object of the present invention, to provide an apparatus of the initially mentioned type with reduced design and construction costs, with which commercial and industrial waste, particularly paper, wood, plastics, etc., can be comminuted effectively.

In the inventive apparatus, the material to be comminuted is effectively comminuted or milled and classified to the desired degree with only one comminuting mechanism, which comprises the comminuting tool having the pocket recesses as well as the comminuting tool having the classification form recesses. The classification form recesses, in conjunction with the pocket-shaped recesses, see to it that the comminuted material is handed over to the material outlet region only when it has reached a desired degree of comminution without requiring any special classification units or further comminuting steps for this purpose. By means of a suitable construction of pockets and classification form recesses or by suitably matching pockets and classification grooves to one another, an optimum result can be obtained for each application with simple structural means. The production costs of this apparatus can be reduced considerably by these means in comparison to those of conventional comminuting apparatuses.

The pockets or also the classification form recesses can be provided in the driven comminuting tool or also in the comminuting tool, which is stationary or rotating at a low circumferential speed. Depending on the nature of the material to be comminuted or on the size or consistency that the comminuted material is desired to have, it is possible to dispose one or more pockets in the direction of the material loading chamber as well as in the direction of the material outlet region. The classification form recesses preferably are groove-shaped and are kept open towards the material loading chamber, as well as towards the outlet region. The classification or comminuting result can easily be influenced by the width, depth, etc. of the grooves. Moreover, it is likewise possible to maintain the classification form recesses towards the material loading chamber or towards the outlet region of the receiving vessel open.

Preferably, the comminuting tool, which has the pocket recesses, is a rotatably mounted, driven rotor knife with an essentially disk-shaped configuration, which rotates concentrically with a vertical axis of rotation within an essentially disk ring-shaped stationary knife. Both, the stationary knife and the rotor knife can be of relatively small construction. The driven rotor knife can be driven from below in such a manner, that it is mounted directly on the drive shaft of a reduction gear. Preferably, the stationary knife and the rotor knife separate the material loading chamber from the outlet region.

For a more detailed explanation of the invention, reference is made to the dependent claims, the drawing and the further specification.

DESCRIPTION OF THE PREFERRED EMBODIMENTS

Figure 1:
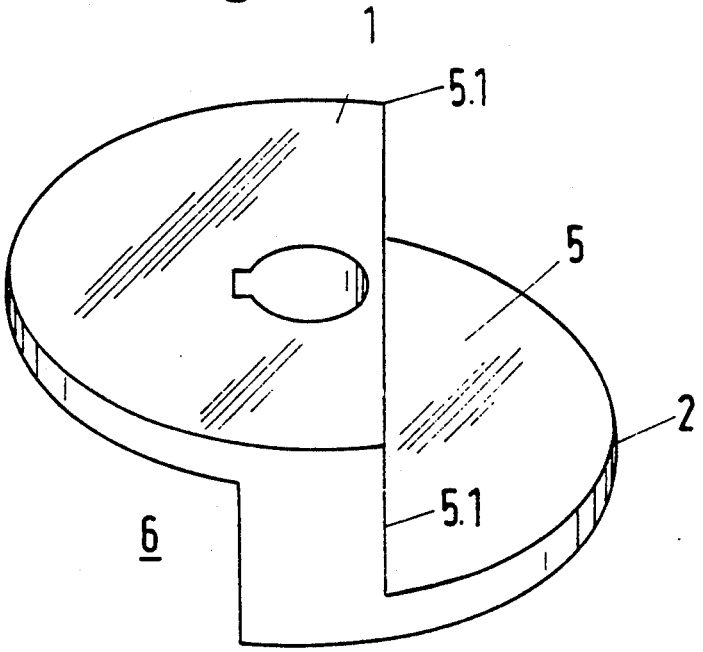
FIG. 1 shows a diagrammatic, perspective representation of a first embodiment of a rotor knife with an upper and a lower pocket recess.

Different embodiments of the first comminuting tool and one embodiment of the second comminuting tool are illustrated in the drawing. The comminuting apparatus as a whole, for comminuting commercial and industrial waste, comprises a receiving container, which preferably, has a vertical main axis and goes over into a funnel in its lower region. Advisably, the comminuting mechanism is disposed in the region of the transition to the funnel shape, so that the outlet region with an outlet opening is below the comminuting mechanism, so that the material charging or loading chamber, which is located above the comminuting mechanism within the receiving container, is separated from the outlet region of the container by the cutting mechanism. Although the details are not shown, the cutting motor should have a drive motor with a drive shaft as well as a reduction gear. The drive shaft of the cutting mechanism or the drive shaft of the reduction gear has an essentially vertical axis of rotation, which advisably coincides with the main axis of the container.

The cutting mechanism of the inventive comminuting apparatus has a first comminuting tool, which, in the embodiments shown, is formed by a rotatably mounted rotor knife 1, which can be shifted in the direction of rotation by means of the driving mechanism. This rotor knife 1 has an essentially disk-shaped configuration with a outer cylindrical surface 2 and is disposed within the second comminuting tool (FIG. 5), which, in the embodiment illustrated, is constructed as a ring disk-shaped stationary knife 3 with an inner cylindrical surface 4. The rotor knife 1 shall be driven from below and therefore from the outlet region of the comminuting apparatus. Due to the overall narrow construction of the rotor knife 1 as well as of the stationary knife 3, the rotor knife 1 can be mounted directly on the drive shaft of a reduction gear, which is not shown.

The stationary knife 3 and the rotor knife 1 separate the material loading chamber of the receiving container from the outlet region of the comminuting apparatus, so that the comminuted material can leave the comminuting apparatus only when all of it has passed through the rotor knife 1 and the stationary knife 3. In the embodiments shown, the rotor knife 1 is provided with the pocket-shaped recesses 5 and 6. In the embodiment shown in FIG. 1, a total of two pocket-shaped recesses 5, 6 is provided. The shaped recess 5 is disposed at the top and therefore assigned to the material loading chamber and the other pocket recess is disposed at the bottom and therefore assigned to the material outlet region. These pocket recesses 5, 6 essentially are semicircular in cross section and act together with the classification recesses 7, which are, for example, in the form of continuous grooves as shown in the stationary knife illustrated in FIG. 3. The pocket-shaped recesses 5, 6 and the classification form recesses 7 constitute opposite profiles, which, because of the size and shape selected, represent the classification dimension and therefore the comminuting size or quality of the comminuted material. In a structurally simple manner, the material to be comminuted can be comminuted by a simple configuration of pockets and classification grooves to a dimension, which corresponds to a granulate or a milled material. Moreover, the number of pocket recesses 5 and 6 advisably is selected on the basis of the size of the material, which is to be charged and comminuted, and of the circumferential dimensions of the knife that has been selected. If the material to be comminuted is particularly coarse or larger, it is advisable to provide an upper and a lower pocket-shaped recess, which extend over half the circumferential region of knife 1, as shown in the embodiment of FIG. 1. In the end regions of the upper pocket-shaped recesses 5, cutting edges 5.1 are constructed, which are aligned vertically on the whole. Cutting edges 7.1 are also constructed in the end regions of the classification recesses 7.

Figure 2:
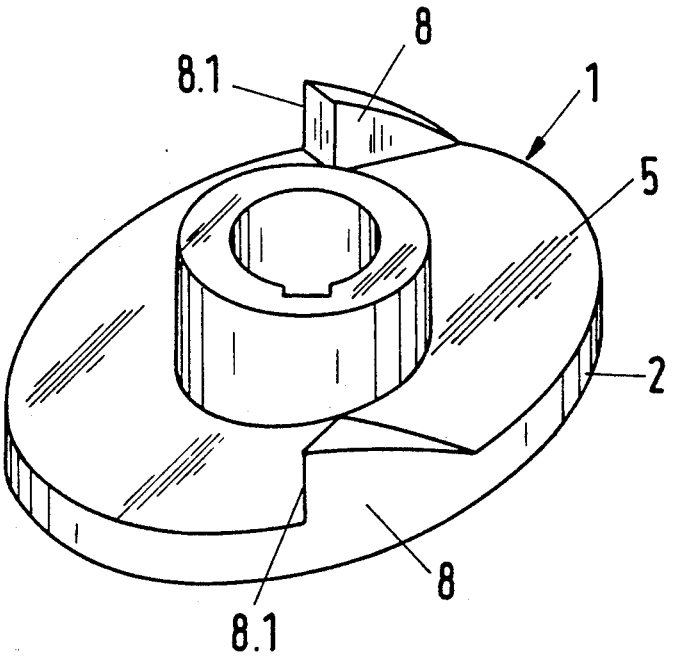
FIG. 2 shows a diagrammatic, perspective representation of an alternative embodiment of a rotor knife with an upper and a lower pocket recess with a disk of inclined construction.
Figure 4:
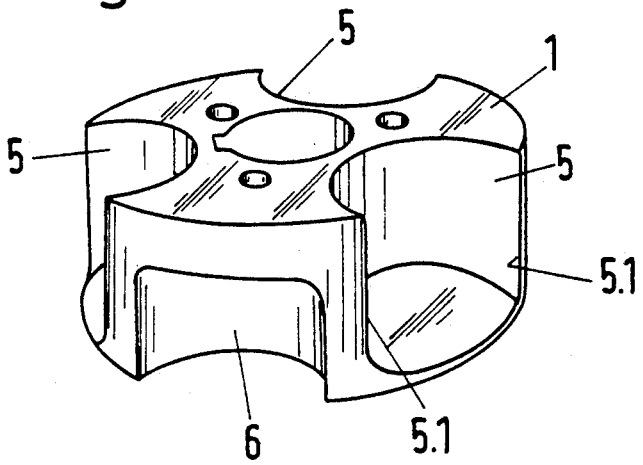
FIG. 4 shows a diagrammatic, perspective representation of a further embodiment of a rotor knife with three upper and three lower pocket-shaped recesses.
Figure 5:
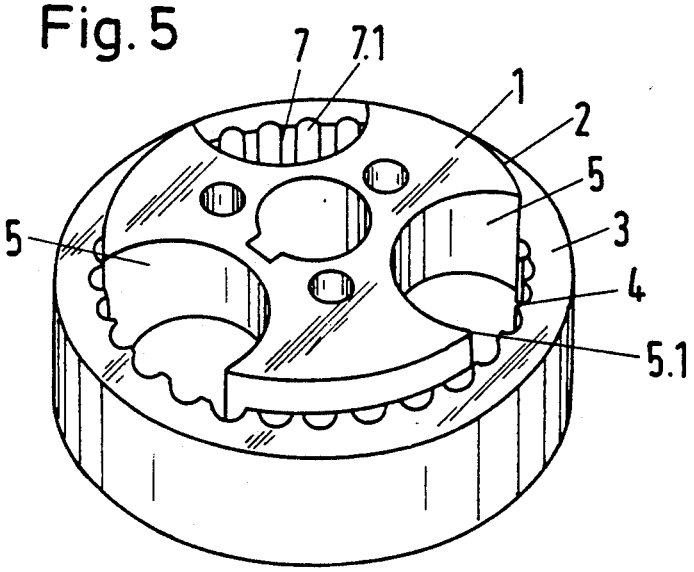
FIG. 5 shows a diagrammatic, perspective representation of a stationary knife corresponding to the embodiment of FIG. 3, as well as the rotor knife corresponding to the embodiment of FIG. 4 in the assembled state.

In the embodiment of the rotor knife 1 shown in FIG. 2, the pocket-shaped recesses 5 and 6 of the rotor knife 1 are formed owing to the fact that the slanted disk forms the rotor knife 1, on the upper side of which dentiform pieces 8 with cutting edges 8.1 are provided. If the material to be comminuted is smaller, it is advisable to provide several pocket-shaped recesses 5 and 6, as shown in FIGS. 4 and 5. For this embodiment, a total of three pocket recesses 5, each with cutting edges 5.1 are disposed on the upper side, that is, aligned in the direction of the material loading chamber and three lower pocket-shaped recesses 6 are provided, which are offset to the upper pocket recesses 5 in the circumferential direction.

Due to the double arrangement of cutting edges 5.1 at each pocket recess 5, cutting edges are provided for clockwise as well as for counter-clockwise rotation.

The pocket-shaped recesses 5 and 6, particularly however the pocket-shaped recesses 6, are inclined from the bottom surface up to the classification form recesses 6 or constructed in arched form, so that, in conjunction with the classification form recesses 7, they act so as to convey the material downwards. If the material to be comminuted is very large, a primary crusher, which is formed, for example, by a toothed, inclined plate, as illustrated in greater detail in the European publication 0 285 011, is disposed ahead of the rotor knife 1.

When the inventive comminuting apparatus is operating the material to be comminuted passes from the loading chamber of the receiving container into the pocket-shaped recesses 5 of the rotor knife 1, which is facing or assigned to the material loading chamber. During the rotary motion of the rotor knife 1, the material to be comminuted is severed, cut or ground up, depending on the length and depth of the classification form recesses 7, by the cutting edges 5.1 or the opposite cutting edges of the classification form recesses 7. The severed material, which is to be comminuted, is then passed on to the pocket recess 6, which is assigned to the outlet region, when this pocket recess 6 stands in front of the classification form recess holding the severed material 7, which is to be comminuted. Depending on the shape of the pocket-shaped recess contour, the severed, comminuted material is then conveyed to the material outlet region. This is possibly particularly because the severed, comminuted portion of the material expands after the comminuting process in the lower pocket 6 and can be caught hold of. The pocket recesses 5 and 6 and the classification form recesses 7 can be provided either in the driven comminuting tool or also in a stationary comminuting tool or also in a comminuting tool rotating with a low circumferential speed. At low revolutions per minute, or also when the diameter of the knife is smaller, it is advantageous to provide the pocket recesses in the rotor knife 1, as shown in the embodiments. At higher revolutions per minute and with a larger knife diameter, the providing of pocket-shaped recesses 5 and 6 in the stationary knife offers advantages, since the centrifugal force also can be used additionally for the ejection in order to take off the severed, comminuted material. In this case, the corresponding classification form recesses should be provided in the rotor knife in an analogous manner.

Figure 3:
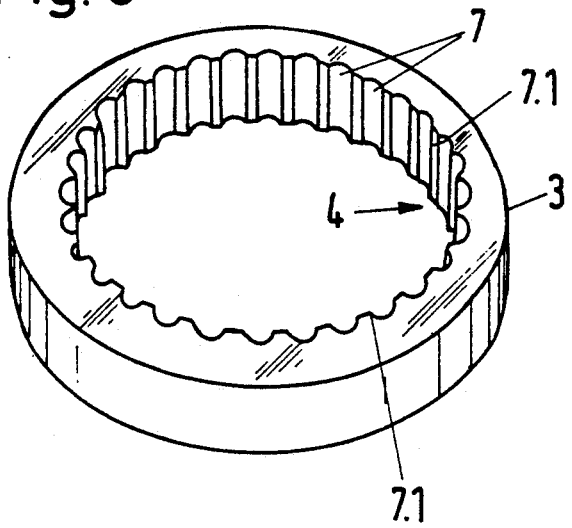
FIG. 3 shows a diagrammatic, perspective representation of an embodiment of a stationary knife having a ring-disk design and groove-shaped classification recesses.
Figure 6:
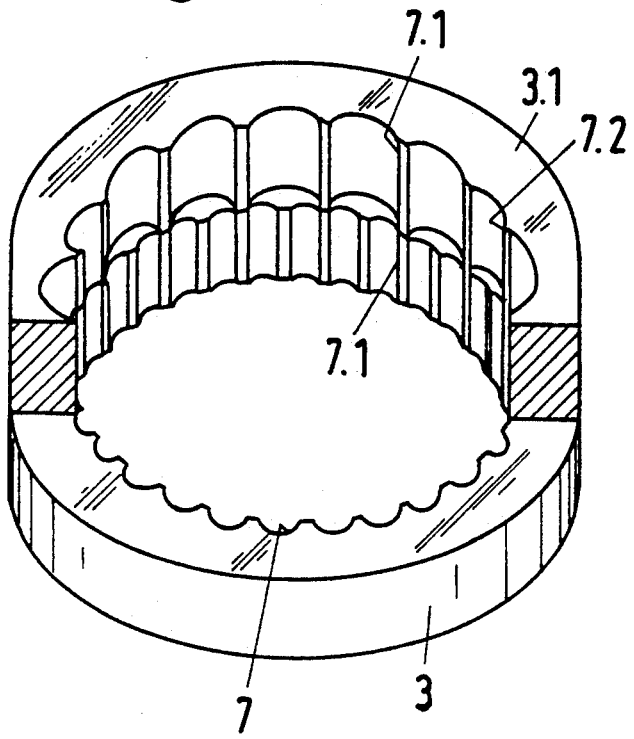
FIG. 6 in a representation similar to that of FIG. 3, shows an alternative embodiment with two stationary knives in a construction in the form of a ring disk and with groove-shaped classification form recesses of different size for a coarse preliminary cut and for a cut that becomes finer, and FIG. 7 in a representation similar to that of FIG. 2 of an alternative embodiment of a rotor knife with an upper and a lower pocket recess, shows through a spiral screw segment-shape tool construction.

In FIG. 6, an embodiment of a cutting tool is shown, which is provided with classification recesses and has two stationary knives 3, 3.1, which are disposed one above the other. The upper stationary knife 3.1 with the sealed design of the groove-shaped classification recesses 7.2 serves as a coarse stationary knife for the preliminary cut. The stationary knife 3.1 underneath, with its classification form recesses 7, serves for a refining cut of the material charged and has, for example, a construction as shown in FIG. 3. Due to the arrangement of two or more stationary knives with cuts becoming finer from the top to the bottom, increased throughput rates can be achieved. The rotating comminuting knife, used in this connection, need have pocket-shaped recesses, which are open towards the bottom, only in the region of the stationary knife with the smallest classification form recesses.

Figure 7:
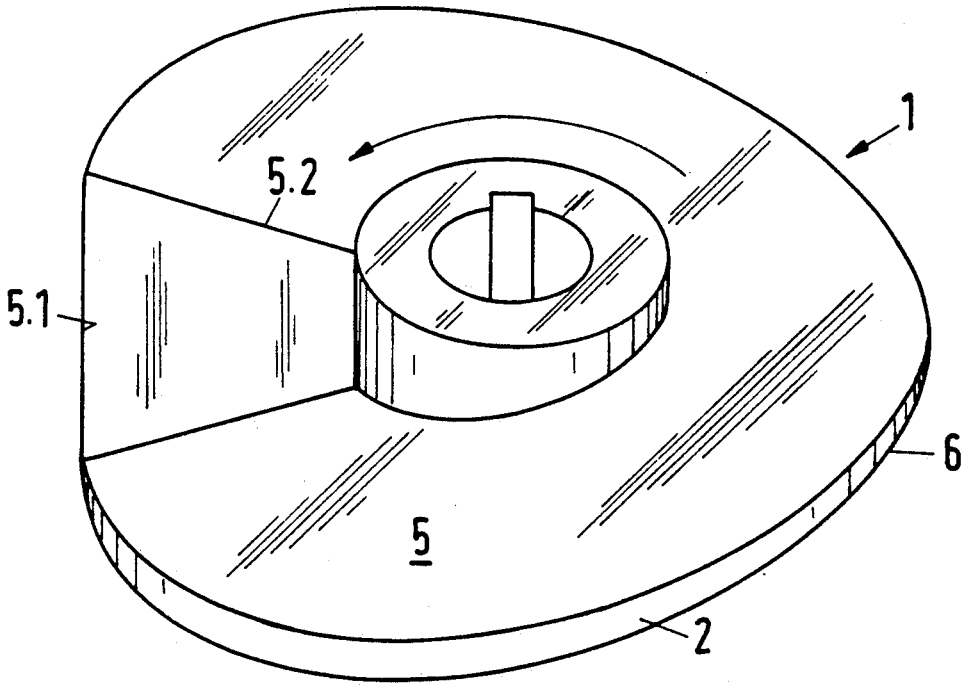

In FIG. 7, a comminuting tool is shown in a spiral screw segment-shaped design. This can be rotated in one direction of rotation. The spiral screw can be a single-flighted screw or a multi-flighted screw. The cutting edges 5.1 work together with the stationary knife having the classification form recesses. The cutting edge 5.2 of the end face works on impact without a counter cutting edge. The spiral screw periphery and, with that, the cylindrical surface of the rotor knife separate the upper cutting space from the lower cutting space.

I claim:

1. An apparatus for comminuting waste material such as paper, wood, plastic and the like in which the waste material passes from a waste material loading chamber to a waste material outlet area, comprising at least two relatively rotatably coaxially disposed comminuting tools rotatable about a rotary axis, one of said tools having classification recesses which open toward the other tool, said other tool having an upstream side facing in the direction of said loading chamber and a downstream side facing in the direction of said outlet area, said other tool having at least one upstream pocket in said upstream side and at least one downstream pocket in said downstream side, said upstream and downstream pockets each have a substantially semicircular cross-sectional configuration, each of said upstream and downstream pockets opening up to said recesses, said at least one upstream pocket being displaced from said at least one downstream pocket such that said at least one upstream pocket is disposed in non-overlapping relationship with said at least one downstream pocket when viewed in a plane perpendicular to said rotary axis.

2. An apparatus for comminuting waste material such as paper, wood, plastic and the like in which the waste material passes from a waste material loading chamber to a waste material outlet area, comprising at least two coaxially disposed comminuting tools, one of said tools having classification recesses which open toward the other tool, said other tool having an upstream side facing in the direction of said loading chamber and a downstream side facing in the direction of said outlet area, said other tool having at least one upstream pocket in said upstream side and at least one downstream pocket in said downstream side, each of said upstream and downstream pockets opening up to said recesses, said other tool being rotatable about a rotary axis, said upstream pocket having an inclined bottom which is disposed at an acute angel relative to said rotary axis, said at least one upstream pocket being displaced from said at least one downstream pocket such that said at least one upstream pocket is disposed in non-overlapping relationship with said at least one downstream pocket when viewed in a plane perpendicular to said rotary axis.

3. An apparatus according to claim 2, wherein said downstream pocket has an inclined bottom disposed at an acute angle relative to said rotary axis.

4. An apparatus for comminuting waste material such as paper, wood, plastic and the like in which the waste material passes from a waste material loading chamber to a waste material outlet area, comprising at least two relatively rotatable coaxially disposed comminuting tools, one of said tools having classification recesses which open toward the other tool, said other tool having an upstream side facing in the direction of said loading chamber and a downstream side facing in the direction of said outlet area, said other tool having at least one upstream pocket in said upstream side and at least one downstream pocket in said downstream side, each of said upstream and downstream pockets opening up to said recesses, said other tool being rotatable about a rotary axis, said upstream pocket having an inclined bottom which is disposed at an acute angle relative to said rotary axis, and cutting elements projecting from said inclined bottom of said upstream pocket, said cutting elements having a cutting edge defined at least in part by a cutting edge surface disposed substantially parallel to said rotary axis.

5. An apparatus for comminuting waste material such as paper, wood, plastic and the like in which the waste material passes from a waste material loading chamber to a waste material outlet area, comprising at least two relatively rotatable coaxially disposed comminuting tools, one of said tools having classification recesses which open toward the other tool, said other tool having an upstream side facing in the direction of said loading chamber and a downstream side facing in the direction of said outlet area, said other tool having at least one upstream pocket in said upstream side and at least one downstream pocket in said downstream side, each of said upstream and downstream pockets opening up to said recesses, said upstream pocket having a spiral configuration formed by a spiral sloping surface and a cutting face, said cutting face having an upstream end and a downstream end, said spiral sloping surface having an upstream end joined to said upstream end of said cutting face, said spiral sloping surface having a downstream end joined to said downstream end of said cutting face.

6. An apparatus for comminuting waste material such as paper, wood, plastic and the like in which the waste material passes from a waste material loading chamber to a waste material outlet area, comprising at least two relatively rotatable coaxially disposed comminuting tools, one of said tools having classification recesses which open toward the other tool, said other tool having an upstream side facing in the direction of said loading chamber and a downstream side facing in the direction of said outlet area, said other tool having at least one upstream pocket in said upstream side and at least one downstream pocket in said downstream side, each of said upstream and downstream pockets opening up to said recesses, another tool with recesses superimposed on said one tool having recesses, said recesses on said other tool being of a different size than the recesses on said one tool having recesses.

7. An apparatus according to claim 5, wherein said cutting face has an outer peripheral cutting edge.

8. An apparatus according to claim 2, wherein there is one upstream pocket and one downstream pocket, said apparatus having an imaginary axial plane which contains said rotary axis, said one upstream pocket being disposed on one side of said axial plane, said one downstream pocket being disposed on the other side of said axial plane.

9. An apparatus according to claim 8, wherein each of said upstream and downstream pockets are spaced from said axial plane.

10. An apparatus according to claim 8, wherein each of said upstream and downstream pockets are contiguous with said axial plane.

11. An apparatus according to claim 1, wherein said other tool comprises a cylindrical member having an upstream wall and a downstream wall, said downstream wall being axially spaced from said upstream wall, said upstream wall and said downstream wall each being perpendicular to said rotary axis.

12. An apparatus according to claim 2, wherein said other tool comprises a cylindrical disc having an upstream disc wall parallel to a downstream disc wall, said upstream disc wall and said downstream disc wall being disposed at an acute angle relative to said rotary axis.

13. An apparatus according to claim 1, wherein each of said upstream and downstream pockets have a radially outer circumferential opening which open up onto said recesses.

14. An apparatus according to claim 1, wherein said other tool has a plurality of upstream pockets displaced from one another such that each upstream pocket is disposed in non-overlapping relationship with one another when viewed in a plane perpendicular to said rotary axis, said other tool having a plurality of downstream pockets displaced from one another and also displaced from said upstream pockets such that each downstream pocket is disposed in non-overlapping relationship with each other and in non-overlapping relationship with said plurality of upstream pockets when viewed in a plane perpendicular to said rotary axis.

15. An apparatus according to claim 14, wherein said other tool has an outer circumferential wall, each of said upstream and downstream pockets have a radially outer circumferential opening opening up onto said circumferential wall and opening up onto said recesses, each of said outer circumferential openings having a terminating edge at said circumferential wall, said terminating edges constituting cutting edges cooperable with said recesses to effect a cutting action.

* * * * *